United States Patent [19]

Wilson et al.

[11] 4,119,078

[45] Oct. 10, 1978

[54] ADJUSTABLE TYPE ARROW REST FOR A BOW

[76] Inventors: Jack K. Wilson; Robert S. Wilson, both of Rte. 16, Box 200, Springfield, Mo. 65807

[21] Appl. No.: 706,816

[22] Filed: Jul. 19, 1976

[51] Int. Cl.[2] ..... F41B 5/00

[52] U.S. Cl. ..... 124/41 A

[58] Field of Search ..... 124/41 A, 41 R, 24 R, 124/86, 88, 22

[56] References Cited

U.S. PATENT DOCUMENTS

| | | | |
|---|---|---|---|
| 3,318,298 | 5/1967 | Bear | 124/41 A X |
| 3,482,563 | 12/1969 | Pint | 124/24 R |
| 3,757,764 | 9/1973 | Ikeya | 124/41 A |
| 3,918,428 | 11/1975 | Wilson et al. | 124/41 A |

*Primary Examiner*—William R. Browne

*Attorney, Agent, or Firm*—John D. Pope, III

[57] ABSTRACT

An arrow rest for a bow is provided which includes a plate that has an arrow pressure point contact area which engages the side of an arrow shaft as it lies on the rest. The plate is not attached to the bow handle but is attached to a spring biased plunger which is movable toward the bow as the arrow passes. Only one plunger is present which is a part of a connection which connects the plate to a bow and includes an interlock for interlocking the rod member to the remainder of the connection to restrain the rod member from rotating motion but permitting motion of the rod member and the arrow rest and arrow pressure point contact area in and out with the spring biased plunger. The interlock and the connection having longitudinal axes that are substantially coextensive with each other when the arrow rest is mounted on a bow.

7 Claims, 3 Drawing Figures

ADJUSTABLE TYPE ARROW REST FOR A BOW

The present invention relates to archery bows and more particularly to an attachment for an archery bow which engages the bottom and one side of an arrow and which may be easily retracted toward the bow by the arrow's action as it is released from the bow.

It is known that the release of an arrow by an archer involves an interaction of force which causes the arrow shaft to normally deflect around the bow window. An improper release can cause the arrow to strike the bow or an arrow rest attached solidly to the bow thereby producing an erratic arrow flight. Various devices have been proposed heretofore in an effort to avoid irregularities in arrow release and to increase accuracy. Among the more effective of these is the device shown in our U.S. Pat. No. 3,918,428. This arrow rest greatly improves the control of an archer over the release of an arrow from a bow but the manufacturing tolerances required by this structure have limited its use.

Among the objects of the present invention may be noted the provision of a combined arrow rest and arrow pressure point contact area which may be readily manufactured to easily attainable tolerances; and the provision of such a rest which effectively operates, yet which can be readily manufactured without burdensome precautions. Other objects and features will be in part apparent and in part pointed out hereinafter.

The invention accordingly comprises the constructions hereinafter described, the scope of the invention being indicated in the following claims.

In the accompanying drawings, in which one of various possible embodiments of the invention is illustrated, FIG. 1 is a partial perspective view of the arrow rest and arrow pressure point contact area of the invention mounted on a bow but with the arrow rest removed;

Corresponding reference characters indicate corresponding parts throughout the several views of the drawings.

Figure 1:
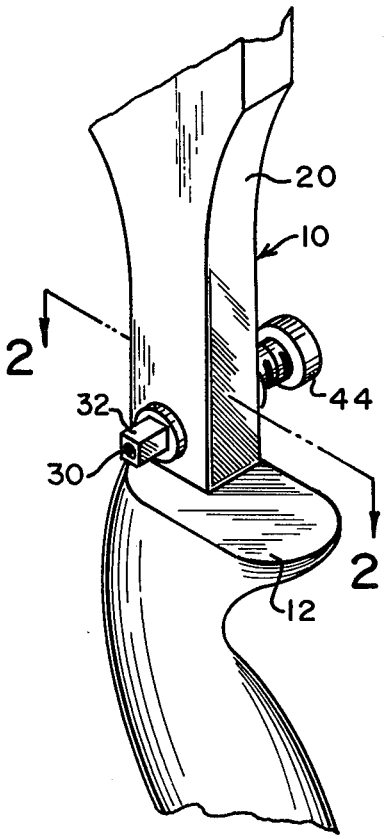

Referring now to the drawings, numeral 10 generally designates a bow which has a conventional handle and a sight window formed with a shoulder 12. The face 20 of the bow faces the archer when in use.

A combined arrow rest and pressure point contact area generally designated by number 22 is attached to a spring biased plunger rod or stem above shoulder 12.

The combined device comprises a generally horizontally disposed plate member 24. An arrow rest 26 is attached to plate member 24 at its lower end 28 and the combination secured to the end 30 of rod 32. In the illustrated embodiment the arrow rest is in the form of a thin vane of nylon or similar material. The arrow rest is preferably inclined upwardly at a small angle so that an arrow (not shown) may be supported thereon and held in contact against the region 34 of plate member 24. Region 34 functions as the arrow pressure point contact area in contact with the arrow.

Figure 2:
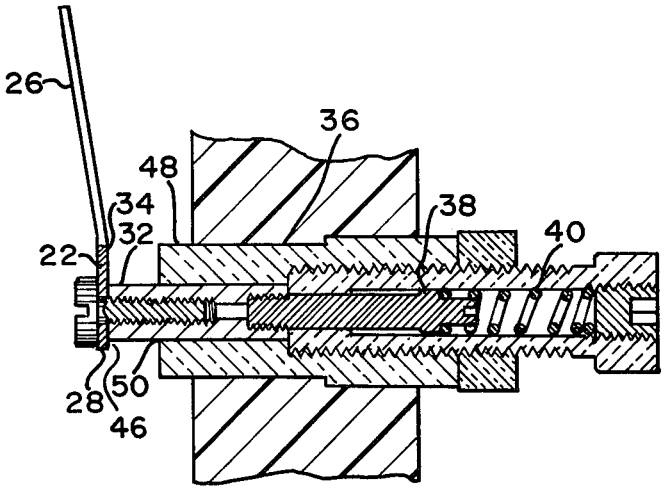
FIG. 2 is a section taken on the line 2—2 of FIG. 1 but on an enlarged scale and with the arrow rest in place.
Figure 3:
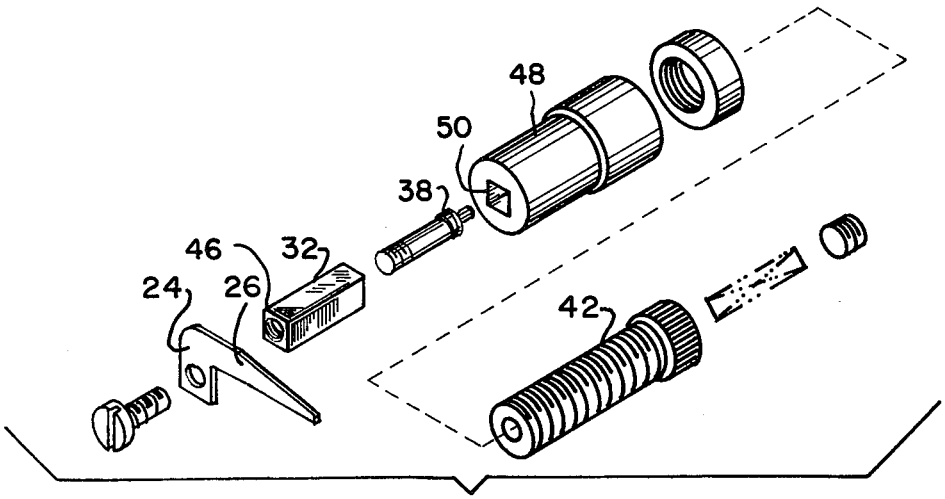
FIG. 3 is a perspective of the parts of the arrow rest and arrow pressure point contact area of the present invention removed from the bow and disassembled.

As seen in FIG. 2 rod 32 passes through an opening in the bow handle and emerges from an internal cavity 36 held in the bow. A collar 38 on rod 32 limits its outward movement. A spring 40 acting upon collar 38 tends to bias rod 32 to its outermost position to hold the arrow rest and arrow pressure point contact area 24 spaced outwardly from bow 10. There may be provision to adjust the tension on spring 40 via a set screw 42 and an adjustment knob 44 (FIG. 1) such as in U.S. Pat. No. 3,482,563.

The end 46 of rod 32 is configured complementarily to the opening 50 in tube 48 so that rod 32 can telescope into tube 48 but is restrained from rotary motion therein. A square configuration for end 46 and opening 50 accomplishes the foregoing but other configurations for the end of rod 32 and the opening in tube 48 may be utilized provided they compliment to interlock rod 32 against rotating motion.

In operation the archer may adjust the initial position of plate member 24 and consequently of region 34 relative to the bow via set screws or the like. Since arrow rest 26 is attached to plate member 24 movement of one will result in simultaneous and corresponding movement of the other thereby changing the position of the arrow. When an arrow is released the arrow's action against the region 34 may cause contact area 22 to move toward the bow against the bias of spring 40. This substantially simplifies obtaining good arrow flight characteristics since there is no change relative to each other between the portion of the device supporting the bottom of the arrow and the portion of the device contacting the side of the arrow adjacent the bow. Since the configuration of the end 46 of rod 32 conforms to the configuration of the opening 50 in tube 48 rotational movement is inhibited without inhibiting the desired telescoping motion. This configuration need not be held to close tolerances since substantial rotational movement can be prevented without close tolerances.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An arrow rest for attachment to an archery bow comprising a movable plate member adapted to be disposed at and connected to one side of a bow, an arrow rest secured to said plate member to support the bottom of an arrow, said plate member having an arrow pressure point contact area which contacts the side of an arrow when the bottom of the arrow is on said arrow rest, connecting means for connecting the plate to a bow including only one telescoping rod member extending through an opening in the side of a bow, means attaching said plate member to a cantilevered position of said rod member, means acting on said rod member to normally bias said plate member and said arrow rest away from a bow while permitting movement of said plate member and said arrow rest and pressure point contact area toward a bow against the bias of said biasing means as an arrow is shot from a bow, and means interlocking said rod member and the remainder of said connecting means to restrain said rod member from rotating motion while permitting motion of said plate member and said arrow rest and pressure point contact area toward a bow, said interlocking means and said connecting means having longitudinal axes that are substantially coextensive with each other when the arrow rest is mounted on a bow.

2. An arrow rest according to claim 1 in which the connecting means includes a tube surrounding the telescoping rod member which tube and rod members have complementary configurations.

3. An arrow rest according to claim 2 in which the complementary configurations of the tube and rod members interlock to restrain said rod member from rotating motion.

4. An arrow rest according to claim 3 wherein said means to normally bias said plate member and said arrow rest are spring means to bias the rod member outwardly of a bow.

5. An arrow rest according to claim 4 further comprising adjustment means to adjust a bias applied by said spring means to regulate the extent of the path of movement of said plate member.

6. An arrow rest according to claim 1 wherein said arrow rest has one end attached to said plate member and the remainder of said arrow rest extends upwardly and outwardly therefrom.

7. An arrow rest according to claim 6 in which said arrow rest is in the form of a thin strip of plastic material.

* * * * *

UNITED STATES PATENT AND TRADEMARK OFFICE

CERTIFICATE OF CORRECTION

PATENT NO. : 4,119,078

DATED : October 10, 1978

INVENTOR(S) : Jack K. Wilson; Robert S. Wilson

It is certified that error appears in the above-identified patent and that said Letters Patent are hereby corrected as shown below:

Above the abstract change John D. Pope, III to John D. Pope III removing the comma.

Column 2, claim , line 56, "position" should read"portion"

Signed and Sealed this

*Sixth* Day of *February 1979*

[SEAL]

*Attest:*

RUTH C. MASON
*Attesting Officer*

DONALD W. BANNER
*Commissioner of Patents and Trademarks*